US005821478A

United States Patent [19]

Schröder-Brumloop et al.

[11] Patent Number: 5,821,478

[45] Date of Patent: Oct. 13, 1998

[54] GENERATION OF AN ELEVATOR DOOR CLOSE WARNING

[75] Inventors: Helmut L. Schröder-Brumloop; Rüdiger Löb, both of Berlin, Germany

[73] Assignee: Otis Elevator Company, Farmington, Conn.

[21] Appl. No.: 775,944

[22] Filed: Nov. 25, 1996

[51] Int. Cl.[6] ..... B66B 13/14; B66B 1/34; G08B 21/00

[52] U.S. Cl. ..... 187/316; 187/390; 187/391; 318/558

[58] Field of Search ..... 187/316, 317, 187/391, 390; 318/558

[56] References Cited

U.S. PATENT DOCUMENTS

| | | | |
|---|---|---|---|
| 4,506,765 | 3/1985 | Payne et al. | 187/29 E |
| 4,832,157 | 5/1989 | Kitano | 187/1 R |
| 5,162,711 | 11/1992 | Heckler | 318/264 |
| 5,216,337 | 6/1993 | Orton et al. | 318/16 |

*Primary Examiner*—Robert Nappi

[57] ABSTRACT

An acoustic signal in an elevator door system is provided if a door close signal is present and a door has not closed within a determined time. A switching frequency of a pulse width modulation signal is reduced such that a motor is caused to provide the acoustic signal.

19 Claims, 2 Drawing Sheets

GENERATION OF AN ELEVATOR DOOR CLOSE WARNING

TECHNICAL FIELD

The present invention relates to elevator door systems and, more particularly, elevator door operation.

BACKGROUND OF THE INVENTION

In an elevator system, the function of a forced door closing is known as nudging. The elevator door system enters into a nudging mode if the entrance to a door is blocked for an extended time. This may occur as a result of an interrupted light beam of an obstruction detection device or as a result of the door being physically held in an opened position. During nudging mode, the door closes at a slower speed than normal with a force restricted by an elevator code and the door reversal devices are no longer in effect to reverse the door movement. Thus, the doors will continuously attempt to close. To alert passengers of this condition, an acoustic signal is generated from a buzzer in the door system. Thus, a warning buzzer is required for each elevator door system in the elevator system.

DISCLOSURE OF THE INVENTION

It is an object of the present invention to provide an improved method and apparatus which alerts passengers of a door closing operation.

According to the present invention, a method for providing an acoustic signal in an elevator door system comprising the steps of: determining if a door close signal is present; if the door close signal is present, determining if a door has not closed within a determined time; and if the door has not closed within the determined time, reducing a switching frequency of a pulse width modulation signal provided to a motor drive such that a motor is caused to provide the acoustic signal.

In further accordance with the present invention, an elevator door closing warning apparatus comprising: an elevator door motor; a controller for providing a pulse width modulation signal having a switching frequency below a normal operating switching frequency; and an elevator door drive for causing said elevator door motor to produce an acoustic signal in response to the pulse width modulated signal.

The present invention provides the advantage of eliminating a warning buzzer, its associated circuitry and its associated wiring for each door system in an elevator system.

BEST MODE FOR CARRYING OUT THE INVENTION

Figure 1:
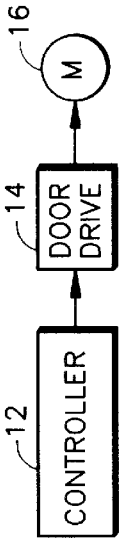
FIG. 1 is a simplified block diagram of an elevator door close warning apparatus in accordance with an embodiment of the present invention.

Referring to FIG. 1, an elevator door close warning apparatus 10 comprising a controller 12, an elevator door drive 14, and an elevator door motor 16 is shown.

Figure 2:
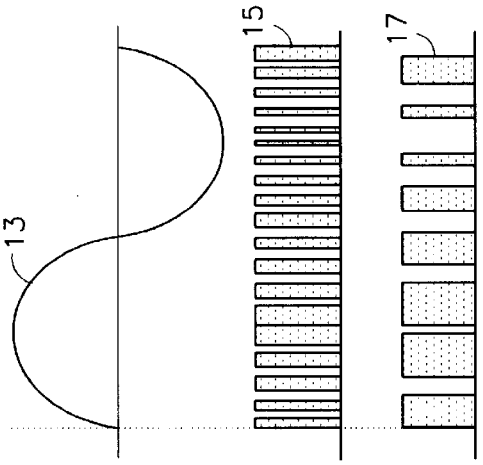
FIG. 2 is an illustration of pulse width modulation signal in accordance with an embodiment of the present invention.

Referring to FIGS. 1 and 2, the controller 12 provides control of door closing operations during both normal door closing and nudge mode closing. In one embodiment, the controller 12 determines if a door in a door system has not closed within a determined time after a door close signal is present. The determined time may be, for example, ten seconds. If the door does not close within the determined time then the controller 12 causes the door to close in the nudging mode. During both normal operation and nudging mode, the controller 12 provides a pulse width modulation signal PWM to the door drive 14. The pulse width modulation signal PWM is generated by varying a pulse/pause ratio for a given period. The repetition rate of the pulses is defined as a switching frequency. A pulse width modulation reference signal 13, a pulse width modulation frequency signal 15 having a normal operation switching frequency and a pulse width modulation frequency signal 17 having a reduced switching frequency are shown in FIG. 2.

Figure 3:
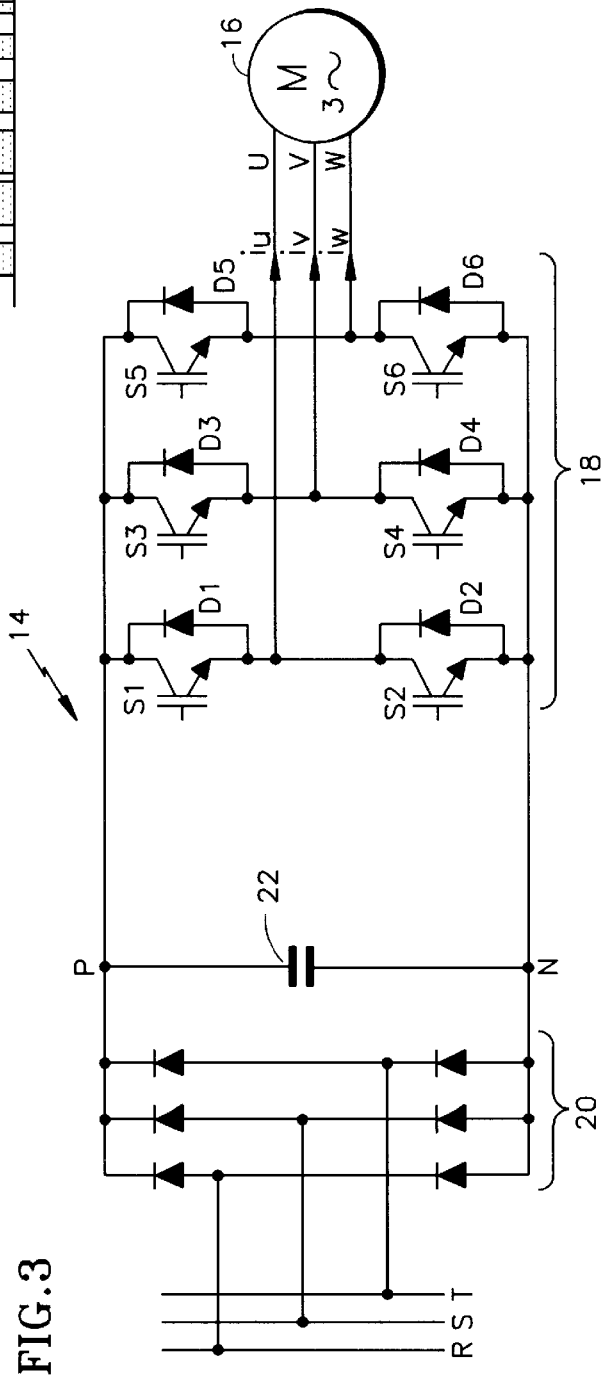
FIG. 3 is a schematic representation of an elevator door drive and motor in accordance with an embodiment of the present invention.

Referring to FIGS. 1 and 3, the door drive 14 and the motor 16 are shown according to an embodiment of the present invention. The motor 16 is supplied with alternating currents $i_U$, $i_V$, $i_W$ from a pulse width modulation voltage source inverter 18 connected to a voltage DC source 20 through a DC link comprising terminals of opposite polarities P, N and a capacitor bank 22. The DC source 20 in general is achieved with a rectifier, or an AC/DC converter, supplied with AC power from supply lines R, S, T. In an alternative embodiment, a two phase AC power system is utilized.

The pulse width modulation voltage source inverter 18, in one embodiment, comprises a plurality of switches S1–S6 such as IGBTs. Connected across each switch S1–S6 is a free-wheeling diode D1–D6 for providing a path for reactive current flow. Actuation of the switches S1–S6 in the pulse width modulation voltage source inverter 18 occurs in accordance with a pulse width modulation scheme as is described herein below. Accordingly, the motor currents $i_U$, $i_V$, $i_W$ are controlled by the pulse width modulation signal PWM provided by the controller 12. During normal operation, the controller 12 provides the pulse width modulation signal PWM having a normal operating switching frequency. In one embodiment, the normal operating switching frequency is ten kilohertz or higher. According to one example, the normal operating switching frequency is between ten kilohertz and twenty kilohertz. The present invention may be implemented with any pulse width modulation drive without departing from the spirit or scope of the present invention.

Figure 4:
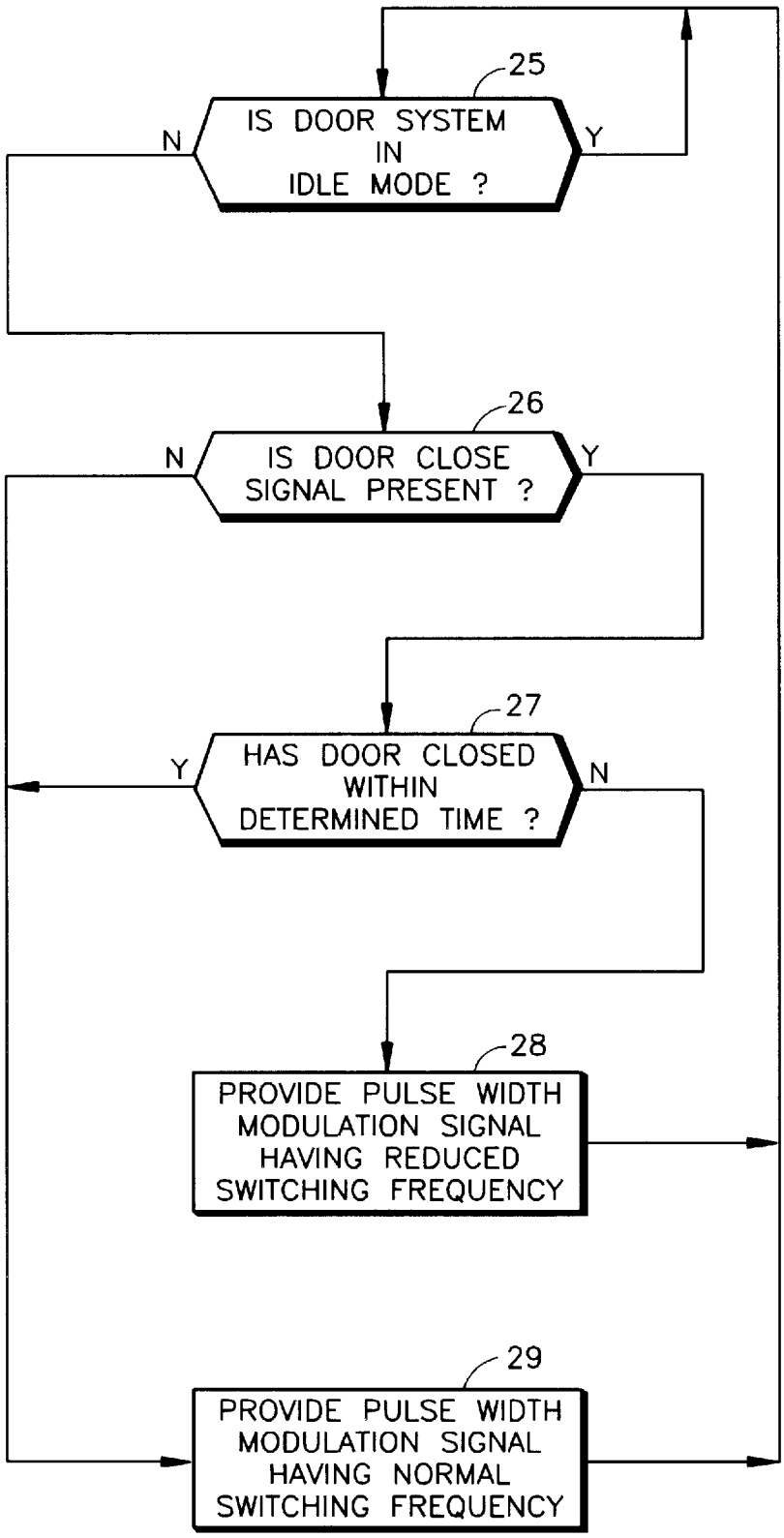
FIG. 4 is a flow chart illustrating an embodiment of an operation of the present invention.

Referring to FIG. 4, an embodiment of the present invention operates as follows. The controller 12, in step 25, determines if the door system is in an idle mode. If not, the elevator door close warning apparatus 10 moves to step 26 and the controller 12 determines if the door close signal is present. If the door close signal is not present then the elevator door close warning apparatus 10 moves to step 29 and resumes normal operation. If the door close signal is present then the controller 12, in step 27, determines if the door has not closed within the determined time. If the door has closed within the determined time, the elevator door close warning apparatus 10 moves to step 29 and the controller 12 continues to provide the pulse width modulation signal PWM having the normal switching frequency. During normal operation, the controller 12 is responsive to a door reversal request.

If the controller 12, in step 27, determines that the door has not closed within the determined time, the elevator door close warning apparatus 10 moves to step 28 and the controller 12 provides the pulse width modulation signal PWM having a reduced switching frequency. During this operation, in one embodiment, the controller 12 is not responsive to the door reversal request. The reduced switching frequency of the pulse modulation signal PWM causes the motor 16 to generate an acoustic signal. In a preferred embodiment, the switching frequency is reduced to a frequency below the normal operating switching frequency. The acoustic noise is generated as a result of magnetically forced vibrations of copper windings and laminated iron plates of the motor. In one embodiment, the switching frequency is reduced to five hundred hertz. In another embodiment, the switching frequency is reduced to between five hundred hertz and five kilohertz. The driving effect of the output voltage and current is, of course, not affected by this because the requested average values are still achieved in accordance with the pulse/pause ratios.

In an alternative embodiment, the switching frequency is modulated so as to provide a varying acoustic signal. For example, the switching frequency may be alternated between the normal switching frequency and the reduced switching frequency in order to provide a intermittent acoustic signal. In another embodiment, the switching frequency is modulated between two reduced switching frequencies such that a multi-tone acoustic signal is generated.

The elevator door close warning apparatus 10 provides the acoustic signal until the door system is in idle mode and/or until the door close signal is no longer present; for example, if the door closes, the door close signal is discontinued and either the pulse width modulated signal PWM is discontinued or the switching frequency is controlled back again to the normal operating switching frequency.

Thus, the present invention provides the advantage of eliminating the warning buzzer, its associated circuitry and its associated wiring for each door system in an elevator system.

Various changes to the above description may be made without departing from the spirit and scope of the present invention as would be obvious to one of ordinary skill in the art of the present invention.

What is claimed is:

1. A method for providing an acoustic signal in an elevator door system comprising the steps of:

determining if a door close signal is present;

if the door close signal is present, determining if a door has not closed within a determined time; and if the door has not closed within the determined time, reducing a switching frequency of a pulse width modulation signal provided to a motor drive such that a motor is caused to provide the acoustic signal as the motor urges the door toward closure.

2. A method for providing an acoustic signal in an elevator door system as recited in claim 1 wherein the switching frequency is reduced to below a normal operating switching frequency.

3. A method for providing an acoustic signal in an elevator door system as recited in claim 2 wherein the normal operating switching frequency is at least ten kilohertz.

4. A method for providing an acoustic signal in an elevator door system as recited in claim 2 wherein the normal operating switching frequency is between ten kilohertz and twenty kilohertz.

5. A method for providing an acoustic signal in an elevator door system as recited in claim 1 wherein the switching frequency is reduced to five hundred hertz.

6. A method for providing an acoustic signal in an elevator door system as recited in claim 1 wherein the switching frequency is reduced to between five hundred hertz and five kilohertz.

7. A method for providing an acoustic signal in an elevator door system as recited in claim 1 wherein said determined time is ten seconds.

8. A method for providing a varying acoustic signal in an elevator door system comprising the steps of:

determining if a door close signal is present;

if the door close signal is present, determining if a door has not closed within a determined time; and if the door has not closed within the determined time, modulating switching frequency of a pulse width modulation signal provided to a motor drive such that a motor is caused to provide the varying acoustic signal as the motor urges the door toward closure.

9. A method for providing an acoustic signal in an elevator door system as recited in claim 8 wherein the switching frequency is modulated between a normal operating switching frequency and a reduced switching frequency.

10. A method for providing an acoustic signal in an elevator door system as recited in claim 9 wherein the normal operating switching frequency is at least ten kilohertz.

11. A method for providing an acoustic signal in an elevator door system as recited in claim 9 wherein the reduced switching frequency is between five hundred hertz and five kilohertz.

12. A method for providing an acoustic signal in an elevator door system as recited in claim 9 wherein the switching frequency is modulated between two reduced switching frequencies.

13. A method for providing an acoustic signal in an elevator door system as recited in claim 12 wherein each of the two reduced switching frequencies is below a normal operating switching frequency.

14. A method for providing an acoustic signal in an elevator door system as recited in claim 13 wherein the normal operating switching frequency is at least ten kilohertz.

15. A method for providing an acoustic signal in an elevator door system as recited in claim 13 wherein the normal operating switching frequency is between ten kilohertz and twenty kilohertz.

16. An elevator door closing warning apparatus comprising:

an elevator door motor;

a controller for providing a pulse width modulation signal having a switching frequency below a normal operating switching frequency; and an elevator door drive for causing said elevator door motor to both produce an acoustic signal and urge said door toward closure in response to the pulse width modulated signal.

17. An elevator door closing warning apparatus as recited in claim 16 wherein the normal operating switching frequency is at least ten kilohertz.

18. An elevator door closing warning apparatus as recited in claim 16 wherein the pulse width modulated signal is provided during a nudging mode.

19. An elevator door closing warning apparatus as recited in claim 17 wherein the pulse width modulated signal is provided during a nudging mode.

* * * * *